United States Patent [19]

Lyons

[11] Patent Number: 5,072,865

[45] Date of Patent: Dec. 17, 1991

[54] APPARATUS FOR MAKING DECORATIVE BOWS

[75] Inventor: Jeffrey Lyons, Aldan, Pa.

[73] Assignee: Delaware Ribbon Manufacturers, Inc., Philadelphia, Pa.

[21] Appl. No.: 500,580

[22] Filed: Mar. 28, 1990

[51] Int. Cl.[5] ..... A41H 43/00; D04D 7/06

[52] U.S. Cl. ..... 223/46; 223/44; 428/4; 428/5; 493/955

[58] Field of Search ..... 223/46, 44; 428/4, 5; 493/955; 2/151; 28/147

[56] References Cited

U.S. PATENT DOCUMENTS

| | | | |
|---|---|---|---|
| 3,236,426 | 2/1966 | Kerrigan et al. | 223/46 |
| 3,464,601 | 9/1969 | Christensen | 223/46 |
| 3,533,539 | 10/1970 | Henderson | 223/46 |
| 3,545,656 | 12/1970 | Jacobson | 223/46 |
| 3,770,543 | 11/1973 | Darabant | 428/5 |
| 3,790,041 | 2/1974 | Pearson | 223/46 |
| 3,954,212 | 5/1976 | Bolis | 223/46 |
| 4,896,802 | 1/1990 | Nanami | 223/46 |
| 4,948,636 | 8/1990 | Lyons | 223/46 X |

FOREIGN PATENT DOCUMENTS

| | | | |
|---|---|---|---|
| 1192518 | 5/1970 | United Kingdom | 223/46 |

*Primary Examiner*—Werner H. Schroeder
*Assistant Examiner*—Bibhu Mohanty
*Attorney, Agent, or Firm*—Zachary T. Wobensmith, III

[57] ABSTRACT

Apparatus for making decorative bows from lengths of ribbon wherein the apparatus ribbon is fed and wrapped into a plurality of loops which are punched at the center, trimmed to make one or more integral tails and stapled to a card.

2 Claims, 7 Drawing Sheets

51
6
6
76
75
14
16
72
81
73
71
39
51
50
45
26
29
27
47
48
17
28
20
21
18
19
12
46
25
52

FIG. 7
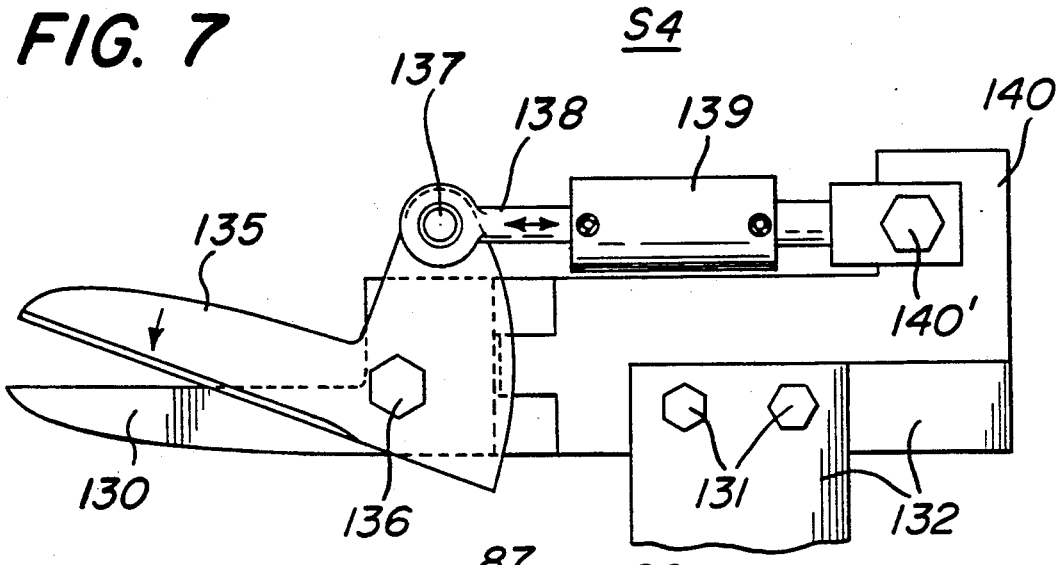
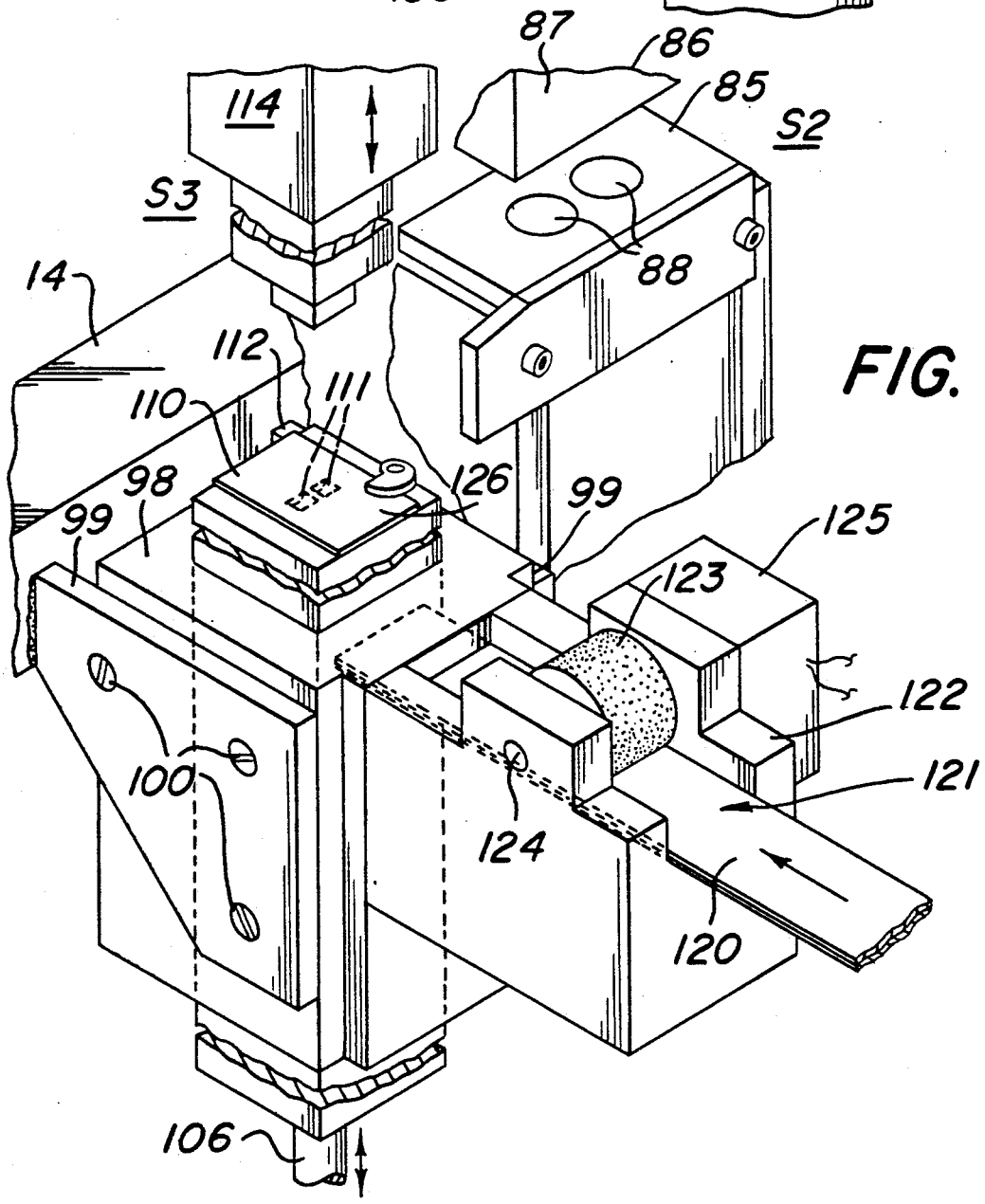
FIG. 8

FIG. 3
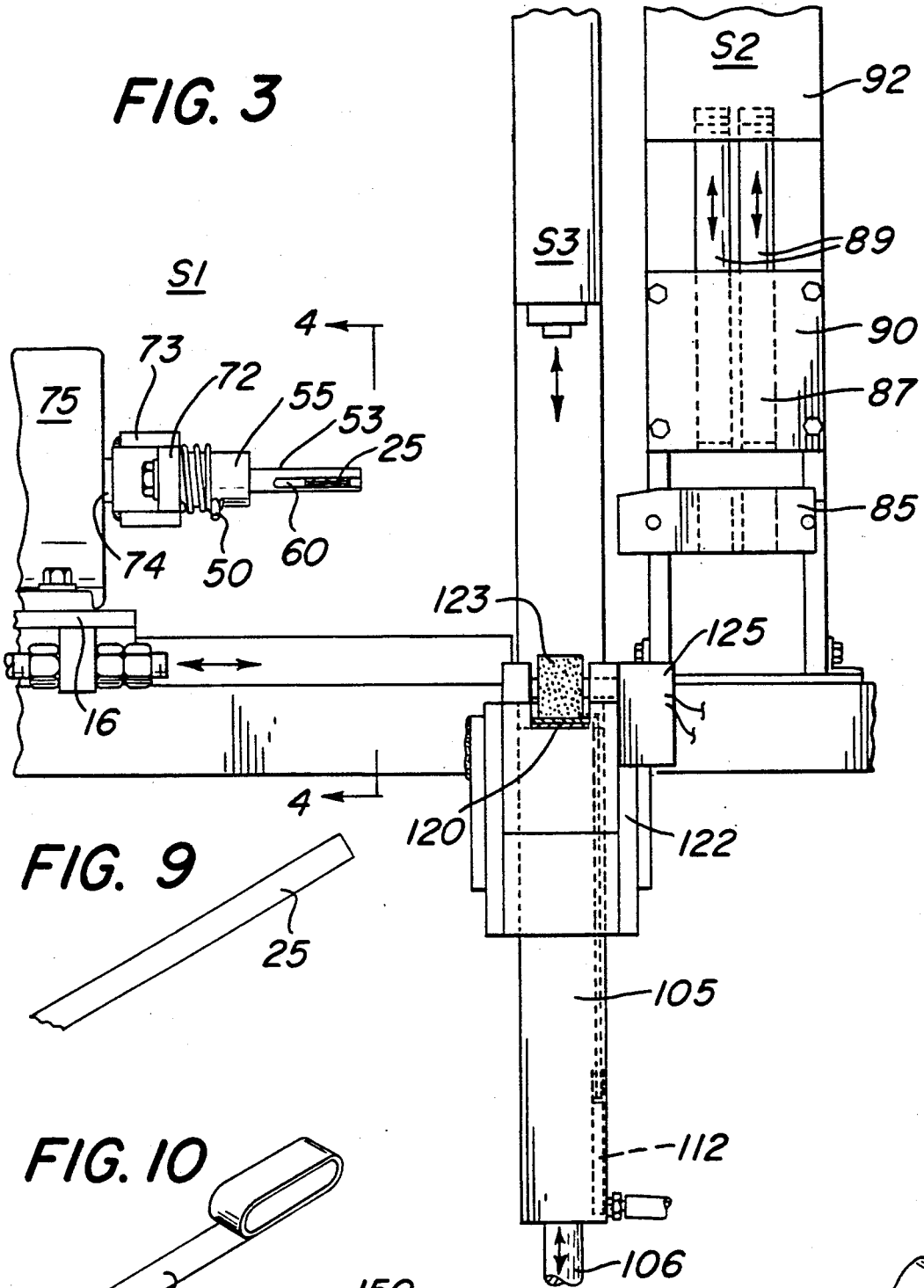
FIG. 9
FIG. 10
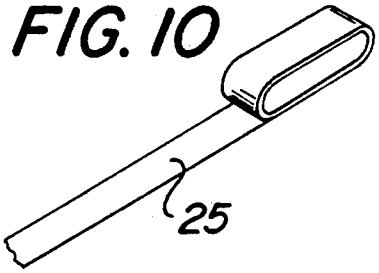
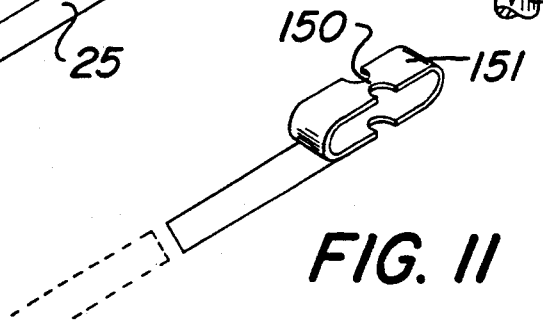
FIG. 11
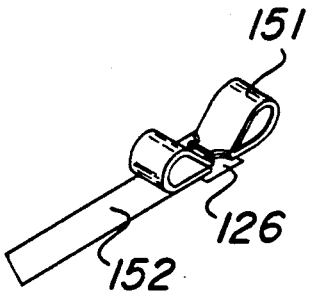
FIG. 12

APPARATUS FOR MAKING DECORATIVE BOWS

BACKGROUND OF THE INVENTION

1. Field of the Invention

This invention relates to apparatus for making decorative bows of ribbon where the ribbon is wrapped, punched, cut, and stapled to a card with the resultant bow having one or more integral tails.

2. Description of the Prior Art

Apparatus for making bows of ribbon is old in the art. Such apparatus forms bows of ribbon by wrapping the ribbon into loops, which are punched or die cut at the middle and stapled to a card, which permits the loops to be fanned and formed into a decorative bow. Such bows may have one or more tails, which were formed of separate strips of ribbon that were separately attached to the cards. This procedure is expensive as it requires additional handling of the bows, and it is difficult to securely fasten the tails to the cards, and to obtain a quality product. It is desirable to make a decorative bow product where the tails are an integral part of the product and which does not require separate handling during manufacture. No comparable apparatus which makes bows having one or more integral tails is available. In my copending U.S. application Ser. No. 421,185, filed Oct. 13, 1989, now U.S. Pat. No. 4,948,636, bows having integral tails, and manufactured by the apparatus of the present invention, are described in greater detail.

SUMMARY OF THE INVENTION

Apparatus for making decorative bows is described having one or more integral tails where the apparatus wraps the ribbon in loops about itself, die cuts the ribbon loops at the center, staples them to a card, and then trims the trailing ribbon to length forming one or more integral tails.

The principal object of the invention is to provide apparatus for making decorative bows having one or more integral tails.

A further object of the invention is to provide apparatus of the character aforesaid that is fast and positive in operation.

A further object of the invention is to provide apparatus of the character aforesaid that is simple and easy to use.

A further object of the invention is to provide apparatus of the character aforesaid that is durable and requires little maintenance.

A further object of the invention is to provide apparatus of the character aforesaid which easily provides bows having one or more tails and which may be of different lengths.

A further object of the invention is to provide apparatus of the character aforesaid which provides a product of superior durability and quality appearance.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which:

FIG. 3 is a vertical, sectional view, taken approximately on the line 3—3 of FIG. 2;

FIG. 7 is a horizontal sectional view, enlarged, taken approximately on the line 7—7 of FIG. 2;

FIG. 8 is a fragmentary perspective view of a portion of the apparatus of FIG. 1 illustrating the punching and stapling portion of the apparatus;

FIG. 9 is a perspective view of a portion of ribbon to be used in making bows in the apparatus of FIG. 1;

FIG. 10 is a view in perspective illustrating the ribbon of FIG. 9 in wrapped or looped condition, beginning the making of a decorative bow;

FIG. 11 is a view in perspective of the wrapped ribbon of FIG. 10 which has been punched and cut;

FIG. 12 is a view in perspective of a bow in completed form stapled to a card.

Figure 1:
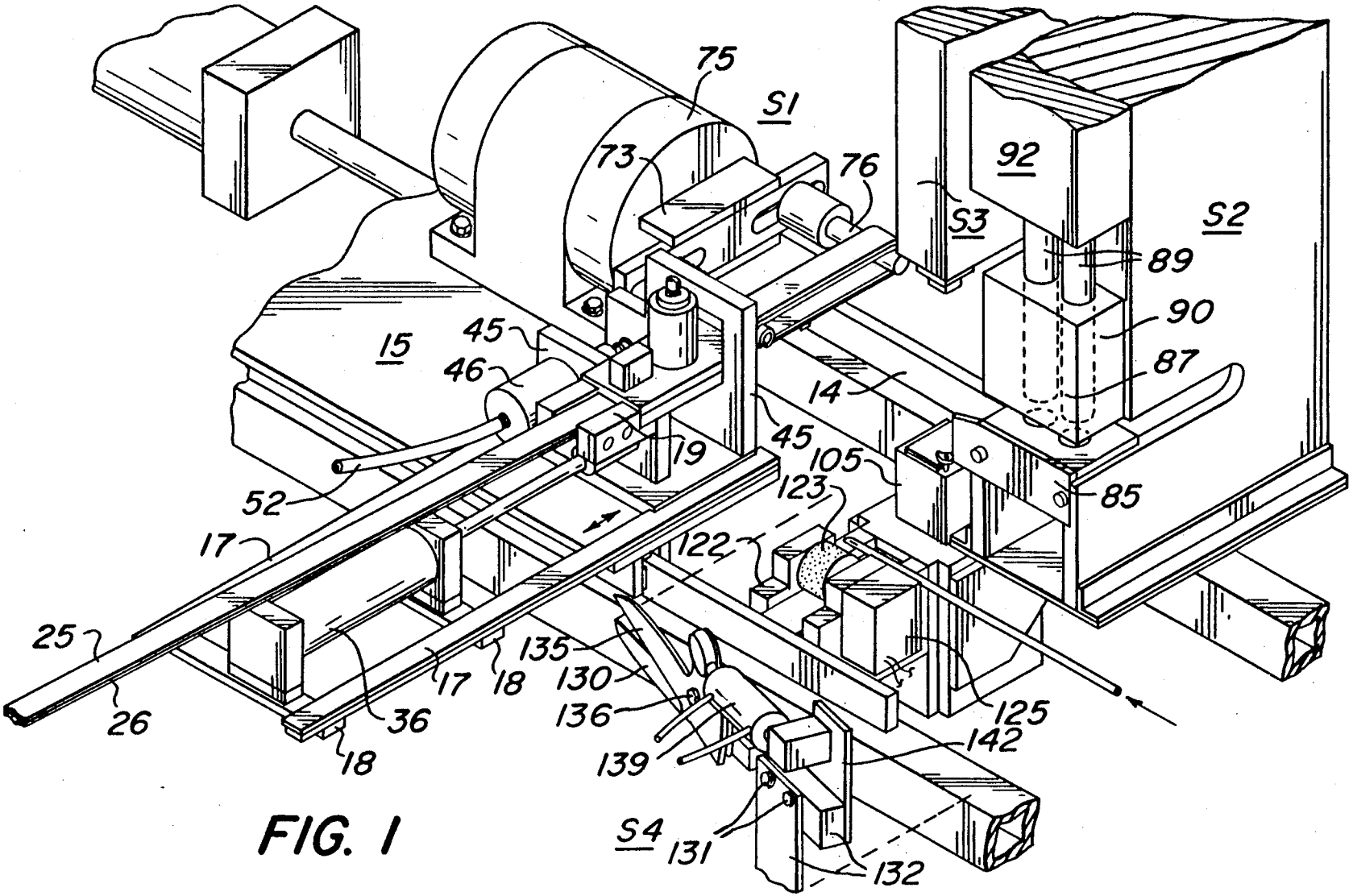
FIG. 1 is a diagrammatic perspective view of a preferred embodiment of the apparatus for making decorative bows, constructed in accordance with the invention.

It should, of course, be understood that the description and drawings herewith are illustrative merely, and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 9 and 13 thereof, a preferred embodiment of apparatus 10 for making decorative bows is illustrated. The apparatus 10 has a ribbon feeding and wrapping section S1, a punching section S2, a stapling section S3 and a trimming section S4. The apparatus 10 includes a frame 11 with frame rails 12 and 14, and with a travelling carriage 15 carried on the frame rails 12 and 14. The carriage 15 has a frame 16 with members 17 and 18, with a ribbon feeding head 19 mounted upon members 17, which includes a pair of plates 20 and 21, between which ribbon 25 from a supply of ribbon (not shown) is directed in a channel 26.

The advance of ribbon 25 in channel 26 is controlled by a ribbon clamp 27, which is connected to a hydraulically actuated spring returned solenoid 28, which has a hose 29 connected to a valve V, which is connected by hose 30 to a source of air under pressure AS.

The mechanism 19 has a rod 35 connected thereto, and to a solenoid 36 mounted to frame members 18, which solenoid controls the position of mechanism 19 on members 17 and consequent feeding of ribbon 25. The solenoid 36 has air supply hoses 37 and 38 connected thereto and through valves V1, V2 and hose 41 to source AS.

The mechanism 19 has a vertical plate 45 connected thereto, which has a solenoid 46 mounted therein, with a chuck clamp pin 47 extending therefrom, and with a return spring 48 thereon. The spring 48 bears against the vertical plate 45 and collar 49 on pin 47, for selective engagement of pin 47 with pin 50 of a ribbon chuck clamp assembly 51, to be described. The solenoid 46 has an air supply hose 52 connected thereto and to valve V.

Figure 2:
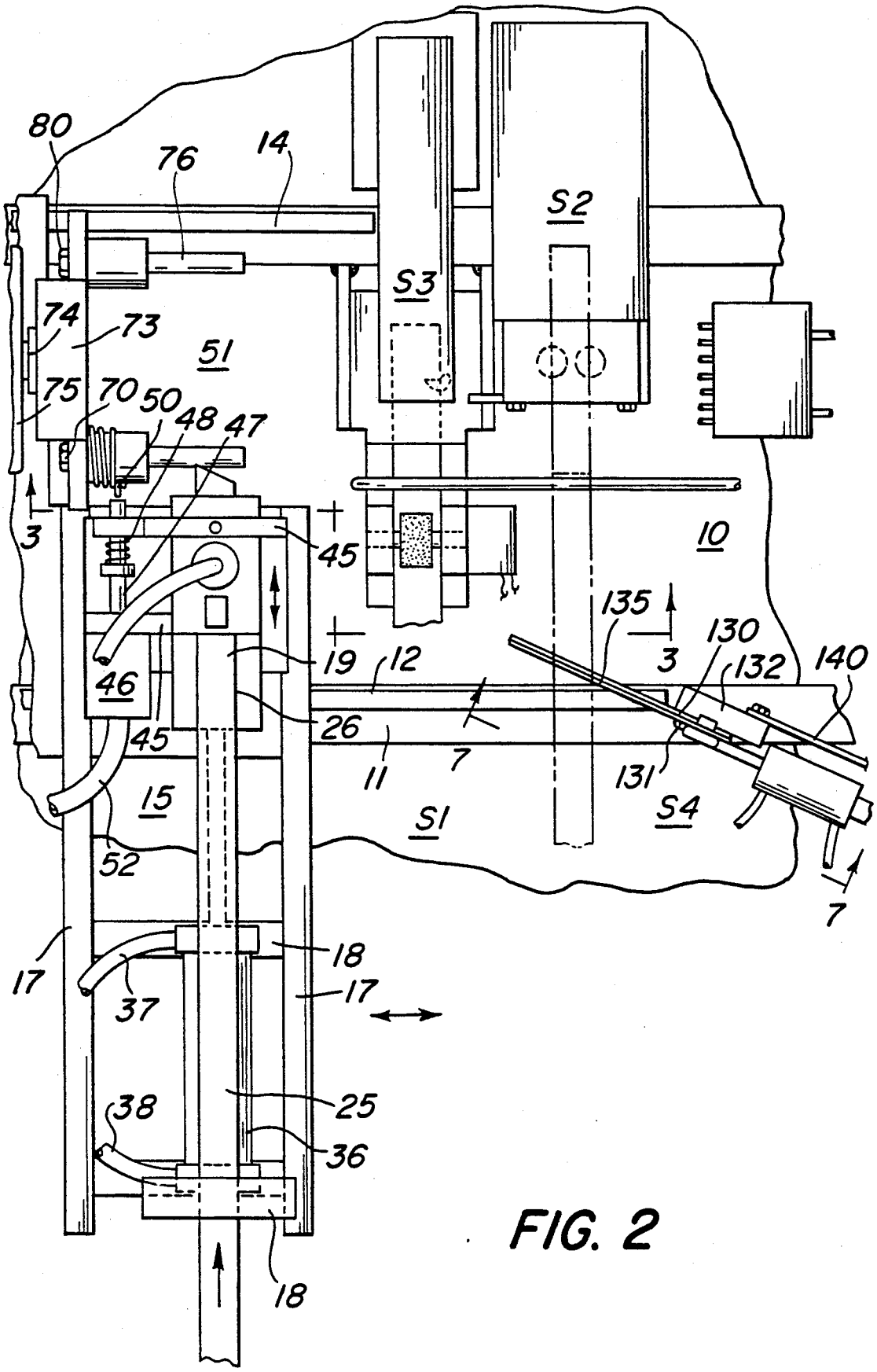
FIG. 2 is a fragmentary top plan view of the apparatus of FIG. 1.
Figure 4:
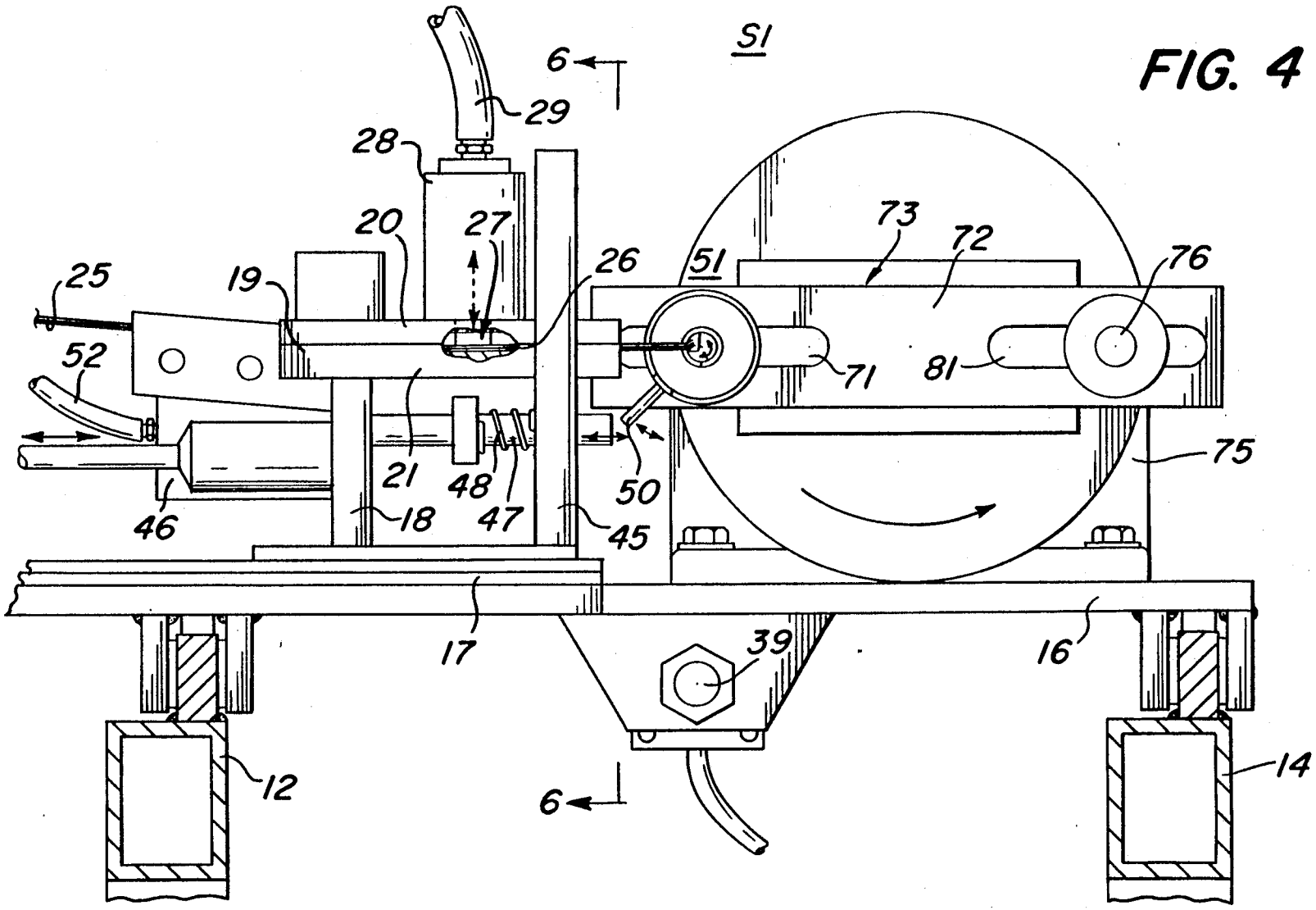
FIG. 4 is a vertical sectional view, enlarged, taken approximately on the line 4—4 of FIG. 3, illustrating the ribbon wrapping portion of the apparatus of the invention.

The carriage 15 has an additional air operated solenoid 39 for movement along rail 12 to the left and right as shown in FIGS. 2 and 4 and is connected by hoses 22 and 23 to valves V3 and V4 to hose 41 to source AS.

Figure 5:
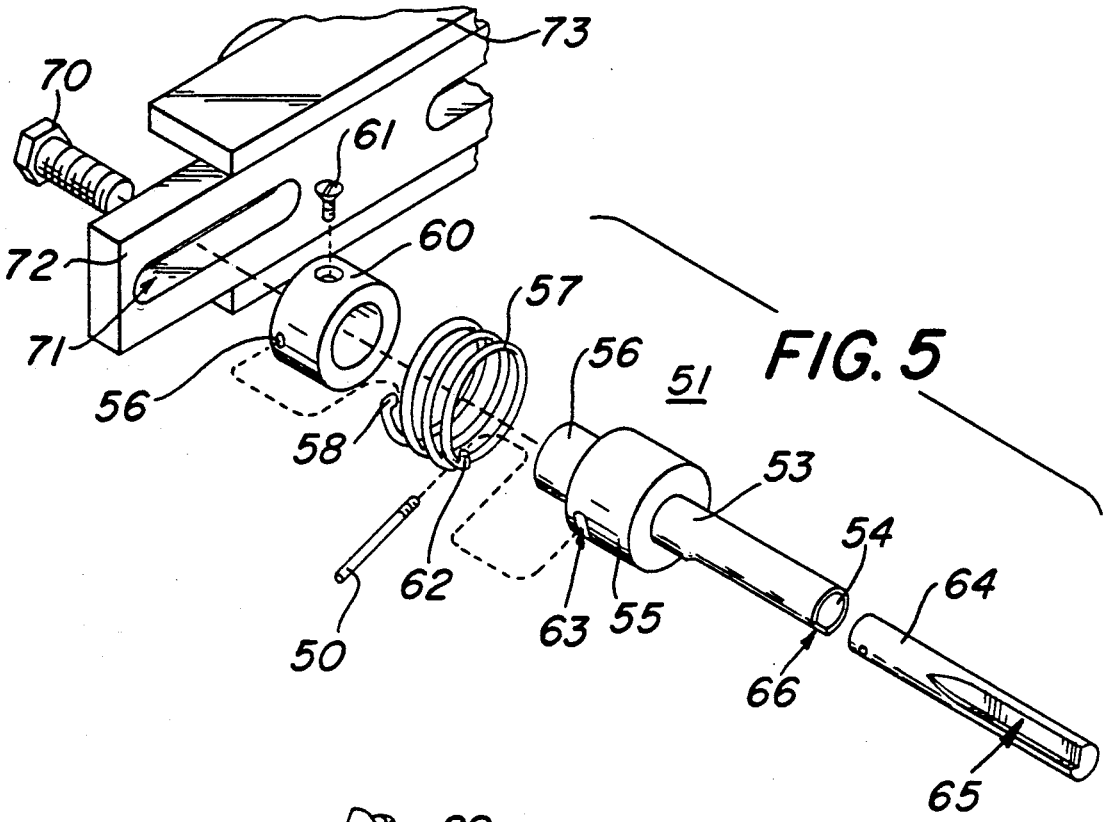
FIG. 5 is an exploded perspective view, enlarged, of the ribbon holding mechanism of FIG. 4.
Figure 6:
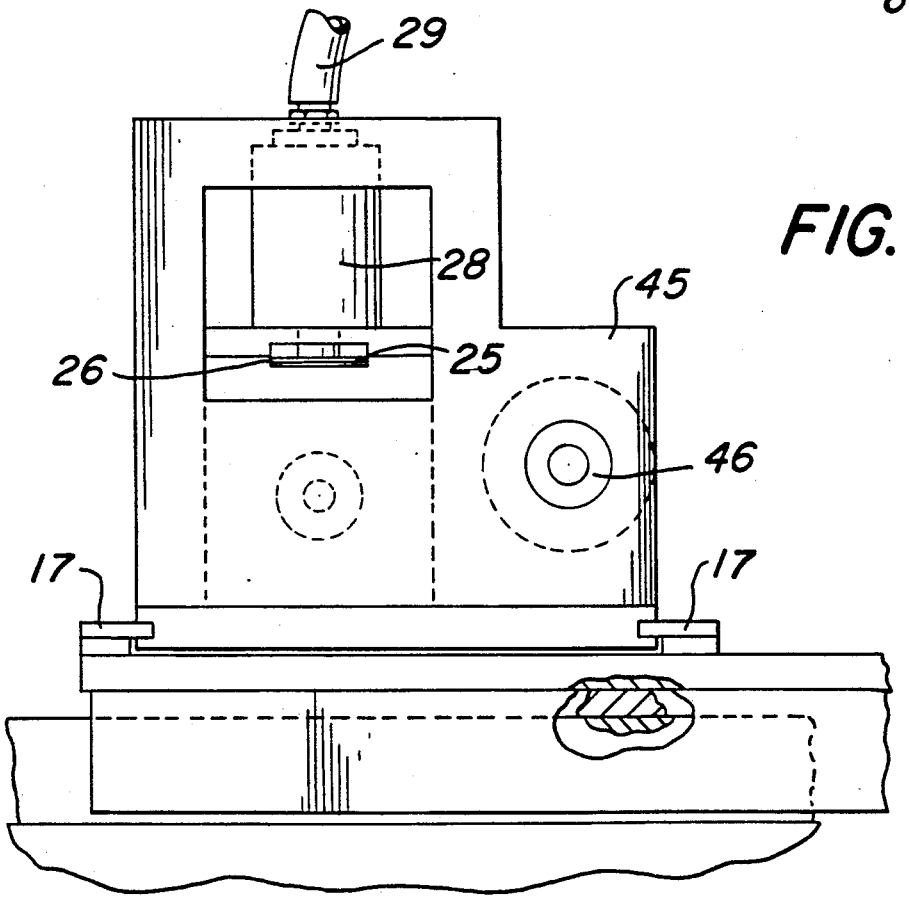
FIG. 6 is a vertical sectional view, taken approximately on the line 6—6 of FIG. 4.
Figure 13:
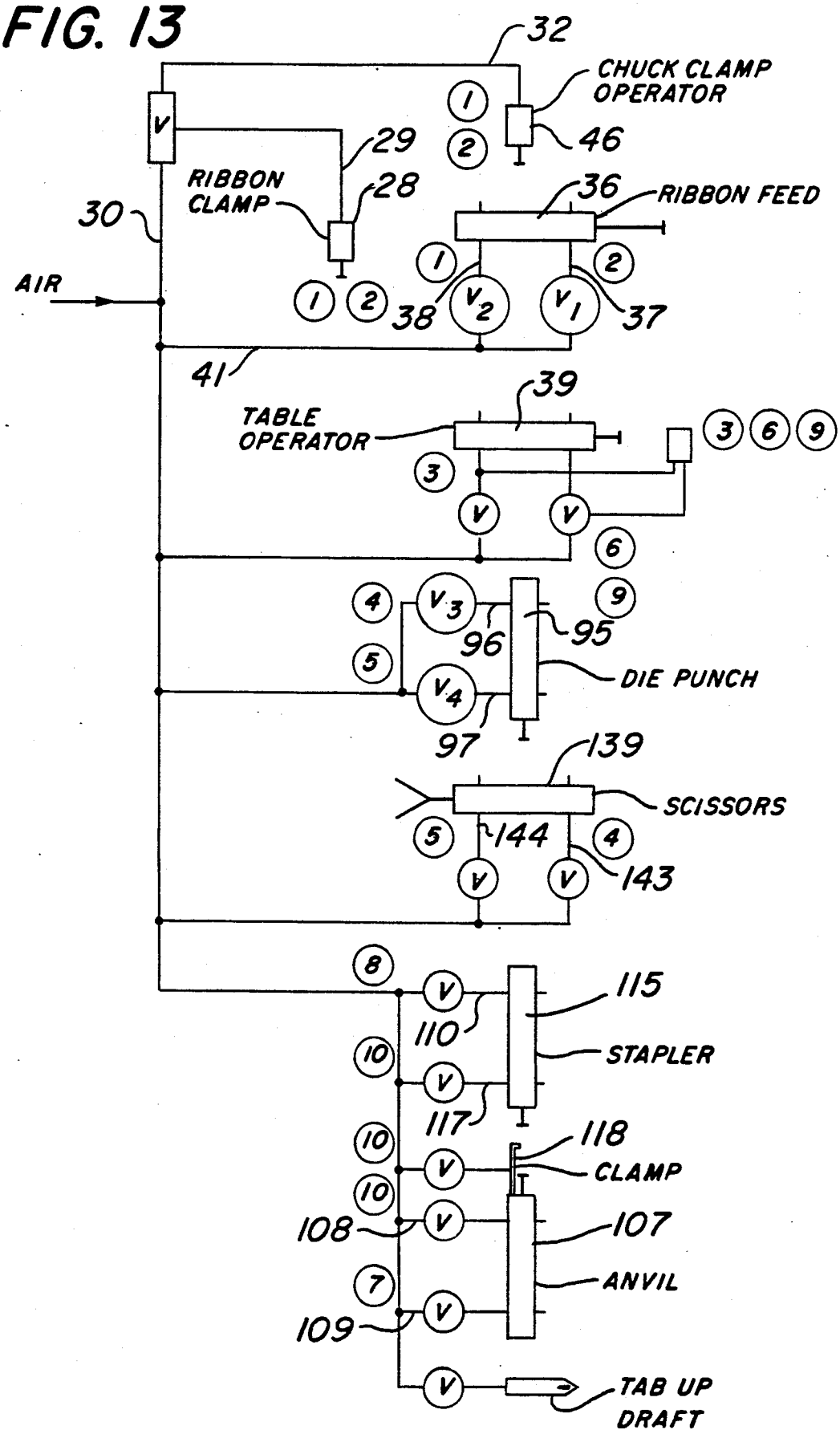
FIG. 13 is a schematic view of the hydraulic circuit of the bow making apparatus of the invention.

The ribbon chuck clamp assembly 51 is shown in more detail in FIGS. 4 and 5 and includes a housing 53 of circular shape with a bore 54, collar 55, and shank 56. The shank 56 has a spring 57 therearound, which has one end 58 engaged in hole 59 in a collar 60, which is retained on shank 56 by set screw 61. The other end 62 of spring 57 is engaged with pin 50, which pin extends through slot 63 in collar 55 and is secured in clamping member 64, which member is carried in the bore 54.

The clamping member 64 has a groove 65 for ribbon engagement and clamping to be described. The housing 53 has a slot 66 therein for ribbon 25 to extend through to engage with groove 65 upon rotation of member 64. The shank 55 is adjustably secured by bolt 70 and movable in a slot 71 in one end of a transverse plate 72, which plate is carried on a bar 73 mounted on shaft 74 which extends from a motor 75, which is mounted to frame 16 of carriage 15. A wrapping shaft 76 is provided, mounted to the other end of plate 72 by bolt 80 in slot 81, and which cooperates with ribbon clamp assembly 51 for ribbon wrapping, to be described.

The punching section S2 is to the right of carriage 15 as shown in FIGS. 1, 2, 3 and 8 and includes a die 85 and an upper circular die punch 87. The die 85 has two circular recesses 88, which the die punch 87 strikes for ribbon loop punching to remove portions of the ribbon prior to stapling to be described.

The punch 87 is mounted to a head 90 carried in block 91, which is mounted to frame plates 92, which are attached by bolts 93 to frame rail 14.

The die punch head 90 is urged into engagement with die 85 by solenoid 95, which is connected to air source AS by hoses 96 and 97 and valves V4 and V5.

To the left of die 85 a stapling station S3 is illustrated, and which includes a block 98 mounted to frame rail 14 by plates 99 and screws 100.

The block 98 has a bore 101, which carries a ram 105 on rod 106, which extends to a solenoid 107, connected to air source AS by hoses 108, 109 and valves V6 and V7. The ram 105 has a stapler plate 110 thereon, which has recesses 111 for staple cinching to be described. The ram 105 also carries a tube 112 from air supply AS, to bring air under pressure to the top of ram 105. A stapler head 114 of well known type is provided, above plate 110, and in communication with a supply of staples (not shown). The stapler head 114 is vertically movable for stapling by solenoid 115, connected by hoses 116 and 117, and valves V8 and V9 to air source AS. The plate 110 has a clamp 118 thereon, to retain pieces of backing paper 120 for stapling, to be described. In front of stapling station S3 a supply of backing paper 120 is provided, which is carried in channel 121 of block 122, and urged to stapling station S3 by a roughened wheel 123 carried in channel 121, and mounted to block 122 by shaft 124 driven from motor 125. The block 122 is integral with block 98.

The backing paper 120 is formed into cards 126 by a blade (not shown). Card 126 may have an adhesive coating (not shown) on the side opposite from stapler head 114 of well known type, and a sheet (not shown) of peelable material to enable the card 126 to be fastened to a package (not shown). A ribbon trimming station S4 is provided, illustrated in FIGS. 1, 2 and 7 in front of punching station S2, and includes a stationary blade 130 fixedly mounted by bolts 131 to plate 132, which is mounted on frame rail 12. A movable scissors like blade 135 is provided, connected to blade 130 by bolt 136, and by pin 137 and rod 138 to solenoid 139, for trimming of ribbon 25 to provide the desired tails.

A rod 140 is connected to solenoid 139, and by bolt 141 to extension 142 of blade 130. The solenoid 139 is connected to air source AS by hoses 143, 144 and valves V10 and V11.

The mode of operation will now be pointed out.

When it is desired to manufacture bows it must first be determined how many tails are desired. The number of tails is dependent upon the number of layers of ribbon 25 to be wrapped, with one tail developed by each layer of ribbon. The ribbon 25 at feeding and wrapping station S1 is fed to clamping member 64 by movement of carriage 15 with ribbon clamp 27 engaged with ribbon 25 until the end of ribbon 25 passes through slot 66 in housing 53 into contact with groove 65 of clamp assembly 51. Solenoid pin 47 is retracted by solenoid 46 and pin 50 rotates, clamping ribbon 25 in housing 53. Ribbon clamp 27 is moved out of engagement with ribbon 25 and motor 75 is activated, so that bar 72 is rotated the desired number of revolutions to wrap ribbon about housings 51 and 76. Motor 75 is halted and carriage 15 is moved to the right as seen in FIG. 1 until it is at punching station S2. Die punch 87 is activated and moves down into contact with the folded loops of ribbon removing portions to provide bridge 150 of bow 151.

The scissors blade 135 of trimming station S4 is activated to move against ribbon 25 and with blade 130 cut the ribbon 25 to length forming a tail 152.

The carriage 15 with trimmed ribbon 25 is moved to the left to stapling section S3. A piece of backing paper 126 is fed onto plate 110, and the punched ribbon 25 is centered over the plate 110. Carriage 15 is moved to the left disengaging the wrapped ribbon from the housings 53 and 76. The stapler head 114 is moved down onto the ribbon 25 and a staple (not shown) is applied across the bridge 150 and through the card 126. The stapler head 114 is retracted and air under pressure form tube 112 impinges on the stapled ribbon (not shown) lifting it off plate 110 and it falls into a collection box (not shown).

The ribbon 25 is fed to the housing 53 and the cycle repeats.

It will thus be seen that apparatus has been provided with which the objects of the invention are achieved.

I claim:

1. Apparatus for making decorative bows of ribbon from an endless supply of ribbon which comprises a feeding and wrapping station for feeding ribbon and wrapping it into multiple loops, a punching station to remove a portion of the ribbon, a trimming station to trim the punched ribbon to length forming at least one integral tail, a stapling station to receive said punched ribbon and a strip of backing paper and to apply a staple through said paper and around said punched ribbon forming the desired bow having at least one integral tail.

2. Apparatus as defined in claim 1 in which said feeding station includes a carriage mounted ribbon feeding head, a ribbon chuck clamping assembly mounted on a bar to receive ribbon from said feeding station, a ribbon wrapping shaft carried on said bar opposite to said ribbon chuck clamping assembly, said bar mounted to a motor for rotation and ribbon loop wrapping, said ribbon punching station includes a die and a die punch to remove a portion of said ribbon, said trimming station includes scissors to sever the punched ribbon to form at least one integral tail, said stapling section includes means for supplying backing cards, a stapler plate to receive said punched ribbon and said cards one at a time, a stapler head to staple said punched ribbon to said card, and means to discharge said stapled ribbon and card for collection and use.

* * * * *